US005732845A

United States Patent [19]

Armaly, Jr.

[11] Patent Number: 5,732,845

[45] Date of Patent: Mar. 31, 1998

[54] SECURING SYSTEM

[75] Inventor: John W. Armaly, Jr., Walled Lake, Mich.

[73] Assignee: Hold It Products Corporation, Walled Lake, Mich.

[21] Appl. No.: 650,716

[22] Filed: May 20, 1996

[51] Int. Cl.[6] ..... B65F 1/06

[52] U.S. Cl. ..... 220/404; 220/908

[58] Field of Search ..... 220/404, 908; 24/17 B, 3.2, 482, 304

[56] References Cited

U.S. PATENT DOCUMENTS

| | | | |
|---|---|---|---|
| 565,920 | 8/1896 | O'Brien | 24/482 |
| 3,927,445 | 12/1975 | Pavlish | 24/482 |
| 4,041,562 | 8/1977 | Nealy | 24/3.2 |
| 4,338,979 | 7/1982 | Dow | 220/404 |
| 4,923,087 | 5/1990 | Burrows | 220/404 |
| 4,930,166 | 6/1990 | Salloum | 24/17 B |
| 5,518,136 | 5/1996 | Muldner et al. | 220/404 |

*Primary Examiner*—Stephen J. Castellano
*Attorney, Agent, or Firm*—Oblon, Spivak, McClelland, Maier & Neustadt, P.C.

[57] ABSTRACT

A securing system which can optimally be used for securing a container liner around a rim of a container. Such a securing system includes a mounting member which is secured to or integrally formed with the container. An elastic member is held by the mounting member and is stretchable to be extended over the rim of the container, to thereby secure the container liner around the rim of the container. Such a mounting member may be an independent element having a rectangular shape, so that it can easily be mounted on circular containers, and may include a ring portion through which the elastic member is passed.

14 Claims, 2 Drawing Sheets

SECURING SYSTEM

BACKGROUND OF THE INVENTION

1. Field of the Invention

The present invention is directed to a securing system which can secure one element to another element by an elastic member, and which may find particular application of securing a container liner to a container.

2. Discussion of the Background it has been known to use an elastic element to secure a container liner to a container. As a specific example, it is often desirable to secure a trash bag or a trash can liner to a trash can. In such a situation, the trash can liner is placed into the trash can and the top portion of the trash can liner is made to extend over the rim of the trash can. In this situation, a stretchable elastic element can be placed around the trash can liner where it extends around the rim of the trash can, to thereby press the trash can liner against the rim of the trash can to secure the trash can liner to the trash can.

However, such a device which utilizes a single elastic element in this manner suffers from certain drawbacks.

One such drawback is that such an elastic element may find many uses, and as a result such elastic elements are often subject to theft since they can be easily removed from the trash can.

Another drawback with utilizing such a single elastic element is that the elastic element must be removed and kept track of when the trash can liners are being replaced.

SUMMARY OF THE INVENTION

Accordingly, one object of the present invention is to provide a novel securing system which can overcome the drawbacks discussed above.

One more specific object of the present invention is to provide a novel securing device which can be used to secure a container liner around a rim of a container. This securing device of the present invention includes a mounting member which is secured to the container. The mounting member holds an elastic member which is stretchable to extend over the rim of the container to secure the container liner around the rim of the container.

The novel securing device of the present invention allows the elastic member to be secured to the container, so that the elastic member still remains handy when the container liner is being changed. As one further feature, the elastic member can be secured to the mounting member so that the elastic member cannot be removed therein, which provides the added benefit that the elastic member cannot be removed and stolen.

One further specific object of the present invention is to provide a novel securing system which is integrally formed with a container to secure a container liner around a rim of the container. This securing system includes a mounting element integrally formed as a part of the container. This mounting portion holds an elastic member which is stretchable to extend over the rim of the container, to secure a container liner around the rim of the container.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
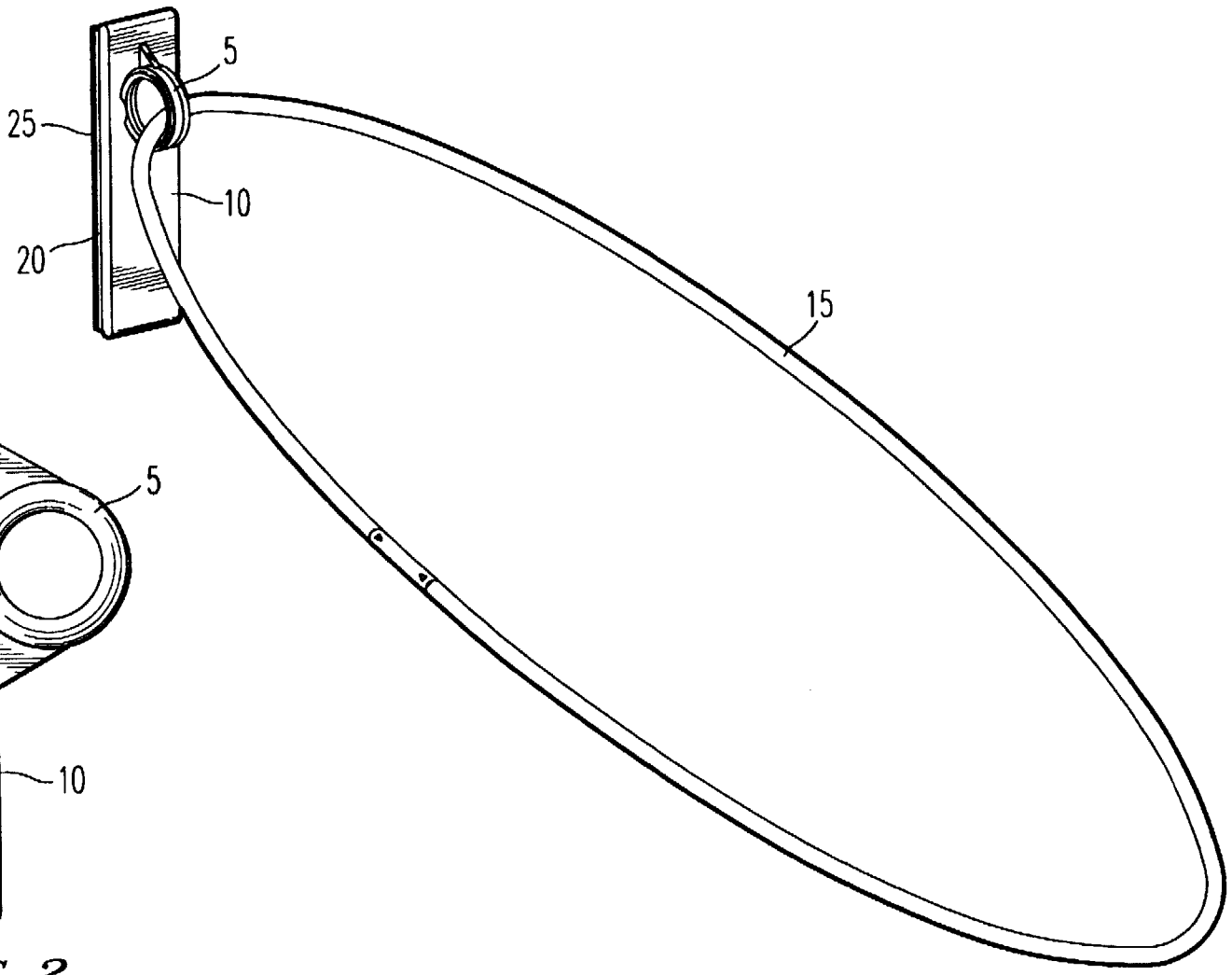
FIG. 1 shows a first embodiment of the present invention.
Figure 2:
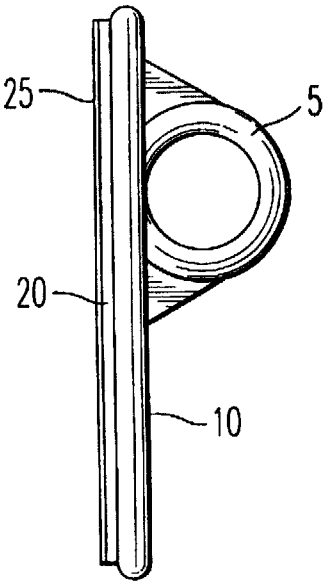
FIG. 2 shows one element of the first embodiment of the present invention.

Referring now to the drawings, wherein like reference numerals designate identical or corresponding parts throughout the several views, and more particularly to FIGS. 1 and 2 thereof, a first embodiment of the present invention is shown.

As is shown in FIGS. 1 and 2, the present invention includes a mounting member 10 which in this embodiment of the present invention is shown as an elongated rectangular member. This mounting member 10 includes a loop or ring portion 5. Furthermore, an endless elastic member 15 is passed through this loop 5. Moreover, according to the present invention, and as is more particularly shown in FIG. 2, the mounting member 10 includes an adhesive portion 20 formed at a backside thereof, i.e. on the side opposite to the side on which the loop 5 is formed. This adhesive member 20 may be a synthetic rubber based adhesive on a polyethylene foam. The adhesive 20 should be an adhesive which is very difficult to remove. A cover layer 25 is formed on the adhesive 20 so that when the device of the present invention is ready to be utilized, the cover layer 25 is peeled off to expose the adhesive 20. When the securing device of the present invention is ready to be secured onto a container or other element, the cover layer 25 is peeled off and then the device of the present invention is secured to the desired element through the adhesive 20. This mounting member 10 may typically be formed of a hard plastic material formed by injection molding.

The elastic member 15 is shown as an endless loop in FIG. 1. However, when the device of the present invention is manufactured the elastic member 15 may be a linear element which has one end passed through the loop 5, and which then has the both ends of the elastic member 15 secured together to form the endless loop.

One envisioned use of the system of the present invention is to secure a container liner to a container, and as one even more specific use of the present invention to secure a trash can liner to a trash can. This use of the present invention is shown in FIG. 3 of the present specification.

Figure 3:
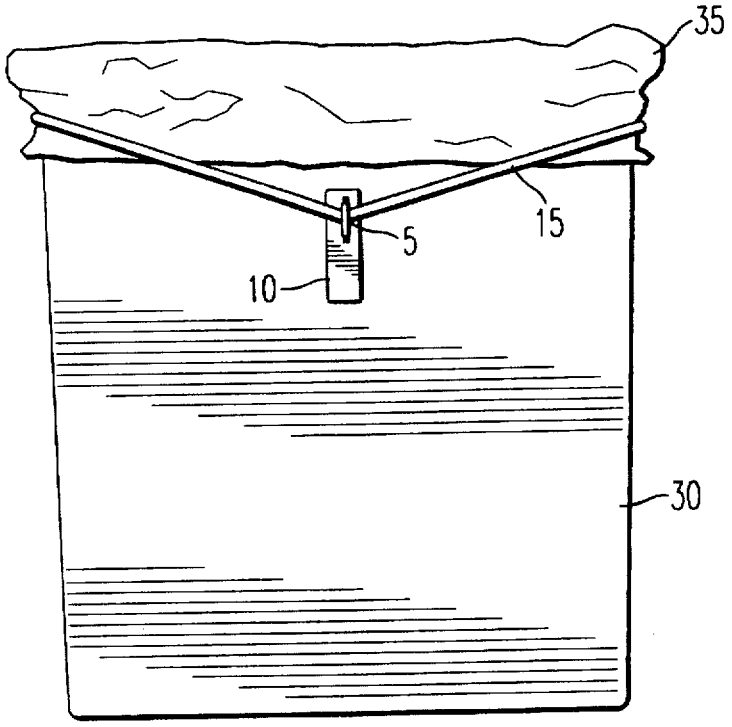
FIG. 3 shows the first embodiment of the present invention as applied to a container and a container liner.

As is shown in FIG. 3, element 30 is a trash can and element 35 is a trash can liner, which is placed into the trash can 30 so that the top edge portion of the trash can liner 35 overhangs the rim of the trash can 30.

In the present invention the mounting member 10 is secured at a position just below where the top edge portion of the trash can liner 35 overhangs the trash container 30. As discussed above, this securing is done by removing the cover layer 25 and pressing the adhesive 20 against the trash can 30. Then, in the present invention the elastic member 15 may be stretched to extend around the rim of the trash container 30 to secure the trash can liner 35 to the trash container 30.

In the example where a round trash can is utilized, the mounting member 10 being of a thin elongated shape provides a beneficial attaching surface as the mounting member can be stably attached even with the curvature of the trash can 30.

With such a device as in the present invention, the trash can liner 35 can be secured to the trash can 30 through the elastic member 15. Further, the elastic member 15 cannot be easily removed from the trash can 30 as the mounting member 10 is secured to the trash can 30 by adhesive 20 and as the elastic member 15 is secured to the mounting member 10. This provides an added security feature of making the elastic member 15 much more difficult to steal.

This also provides a significant advantage in the present invention that when the trash can liner 35 is to be replaced, the person changing the trash can liner 35 does not have to keep track of the elastic member 15 as the elastic member 15 will stay handy and connected to the trash can 30 by the mounting member 10.

Figure 4:
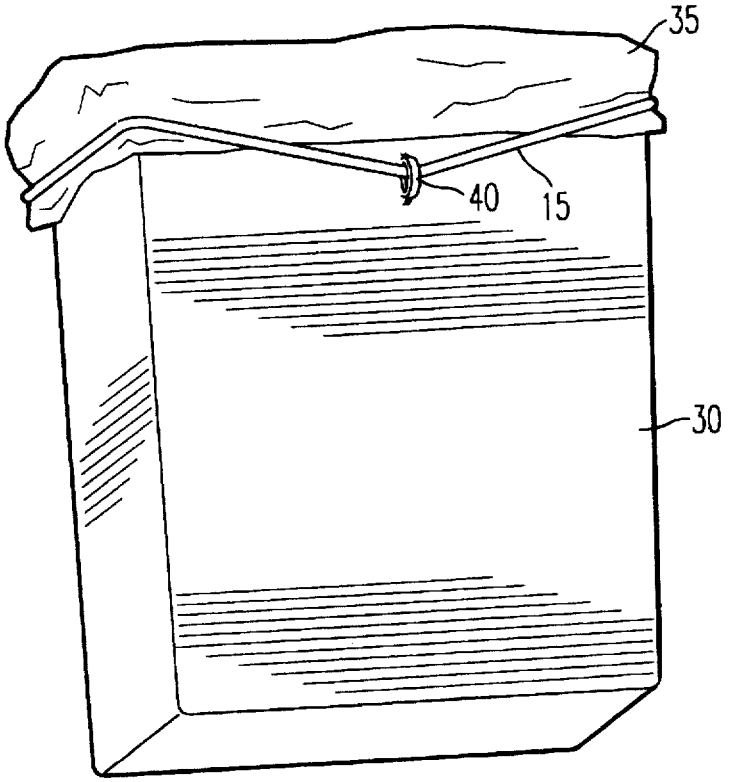
FIG. 4 shows a second embodiment of the present invention.

A second embodiment of the present invention is shown in FIG. 4 of the present specification. In the second embodiment of the present invention, the container 30 itself integrally includes a loop or ring portion 40 formed therein. That is, in this further embodiment, the securing system of the present invention does not include a separate unit with a loop or ring portion, but instead forms the loop or ring portion 40 integrally with the container 30. For example, if the container 30 is formed of molded plastic, the container 30 will be manufactured to include its own ring portion 40. Then, in this further embodiment of the present invention, the elastic member 15 will be placed to pass through and be secured by this loop or ring portion 40.

This further embodiment of the present invention also provides the advantages of being able to secure a container liner 35 to the container 30. Further, with this structure of the present invention the benefits of ensuring that the elastic member 15 remains handy when the container liner 35 is replaced, and preventing the elastic member 15 from being stolen, are still achieved.

If the benefit of making it more difficult to steal the elastic member 15 is not needed, it is possible that the loop portions 5 or 40 can be formed with a pivot or other movable structure or a gap so that the elastic member 15 can be removed therefrom. This would also allow elastic member 15 to be replaced if broken.

The present invention has been shown in one use as being applied for securing a container liner to a container, and more particularly to securing a trash can liner to a trash can. This is only one envisioned use of the device of the present invention. The device of the present invention can clearly find other applications in securing other elements to each other. For example, one further envisioned use of the present invention may be to secure an air conditioner cover to an air conditioner.

Obviously, numerous additional modifications and variations of the present invention are possible in light of the above teachings. It is therefore to be understood that within the scope of the appended claims the present invention may be practiced otherwise than as specifically described herein.

What is claimed as new and is desired to be secured by Letters Patent of the United States:

1. A securing device for securing a container liner around a rim of a container, comprising:

a mounting member including a loop portion;

means for securing the mounting member to the container; and an elastic member passed through the loop portion of the mounting member to be held by the mounting member and stretchable to be extended over the rim of the container to secure the container liner around the rim of the container.

2. A securing device according to claim 1, wherein the means for securing the mounting member to the container comprises an adhesive formed on the mounting member.

3. A securing device according to claim 1, wherein the mounting member is of a rectangular shape and the loop portion is a complete ring portion through which the elastic member is passed so that the elastic member is held by the mounting member.

4. The securing device according to claim 1, wherein the mounting member is of a rectangular shape.

5. A securing device for securing a container liner around a rim of a container comprising:

a mounting member adapted to be secured to the container;

said mounting member including a loop portion; and an elastic member passed through the loop portion of the mounting member to be held by the mounting member and stretchable to be extended over the rim of the container to secure the container liner around the rim of the container.

6. A securing device according to claim 5, wherein the mounting member is secured to the container by an adhesive formed on the mounting member.

7. The securing device according to claim 5, wherein the mounting member is of a rectangular shape and the loop portion is a complete ring portion through which the elastic member is passed so that the elastic member is held by the mounting member.

8. The securing device according to claim 5, wherein the mounting member is of a rectangular shape.

9. A securing device for securing a first element to a second element comprising:

a mounting member adapted to be secured to the second element;

said mounting member including a loop portion; and an elastic member passed through the loop portion of the mounting member to be held by the mounting member and stretchable to be extended over a portion of the second element to secure the first element to the second element.

10. A securing device according to claim 9, wherein the mounting member is secured to the second element by an adhesive formed on the mounting member.

11. The securing device according to claim 9, wherein the mounting member is of a rectangular shape and the loop portion is a complete ring portion though which the elastic member is passed so that the elastic member is held by the mounting member.

12. The securing device according to claim 9, wherein the mounting member is of a rectangular shape.

13. A container which can secure a container liner around a rim of the container, comprising:

a mounting member including a loop portion integrally formed as a portion of the container; and an elastic member passed through the loop portion of the mounting member to be held by the mounting member and stretchable to be extended over the rim of the container to secure the container liner around the rim of the container.

14. The securing device according to claim 13, wherein the loop portion is a complete ring portion through which the elastic member is passed so that the elastic member is held by the mounting member.

* * * * *